US011774218B1

(12) United States Patent
Hague

(10) Patent No.: US 11,774,218 B1
(45) Date of Patent: Oct. 3, 2023

(54) SYSTEMS AND METHODS FOR MEASURING AND COMMUNICATING TACTICAL BATTLEFIELD INFORMATION

(71) Applicant: Cory S. Hague, Aliso Viejo, CA (US)

(72) Inventor: Cory S. Hague, Aliso Viejo, CA (US)

( * ) Notice: Subject to any disclaimer, the term of this patent is extended or adjusted under 35 U.S.C. 154(b) by 235 days.

(21) Appl. No.: 16/900,540

(22) Filed: Jun. 12, 2020

Related U.S. Application Data

(60) Provisional application No. 62/861,213, filed on Jun. 13, 2019.

(51) Int. Cl.
*F41G 3/14* (2006.01)
*F41G 3/06* (2006.01)

(52) U.S. Cl.
CPC ..... *F41G 3/147* (2013.01); *F41G 3/06* (2013.01)

(58) Field of Classification Search
CPC ..... F41G 3/147
USPC ..... 235/417
See application file for complete search history.

(56) References Cited

U.S. PATENT DOCUMENTS 10,922,982 B2 * 2/2021 Magdaleno ..... B64C 39/024
2010/0226210 A1 * 9/2010 Kordis ..... G01S 5/0221 367/127
2014/0218518 A1 * 8/2014 Oliver ..... G08B 13/1672 348/143
2015/0345907 A1 * 12/2015 Varga ..... G01S 13/867 89/41.05

* cited by examiner

*Primary Examiner* — Rafferty D Kelly
(74) *Attorney, Agent, or Firm* — STOUT, UXA & BUYAN, LLP; Donald E. Stout

(57) ABSTRACT

The present invention is a system and device which automatically measures and reports tactical information, allowing the user to efficiently communicate with command units. It is ideally a rifle mounted device, which can measure range, orientation, and position. The present invention can automatically report all tactical information, including enemy combatant positions.

14 Claims, 1 Drawing Sheet

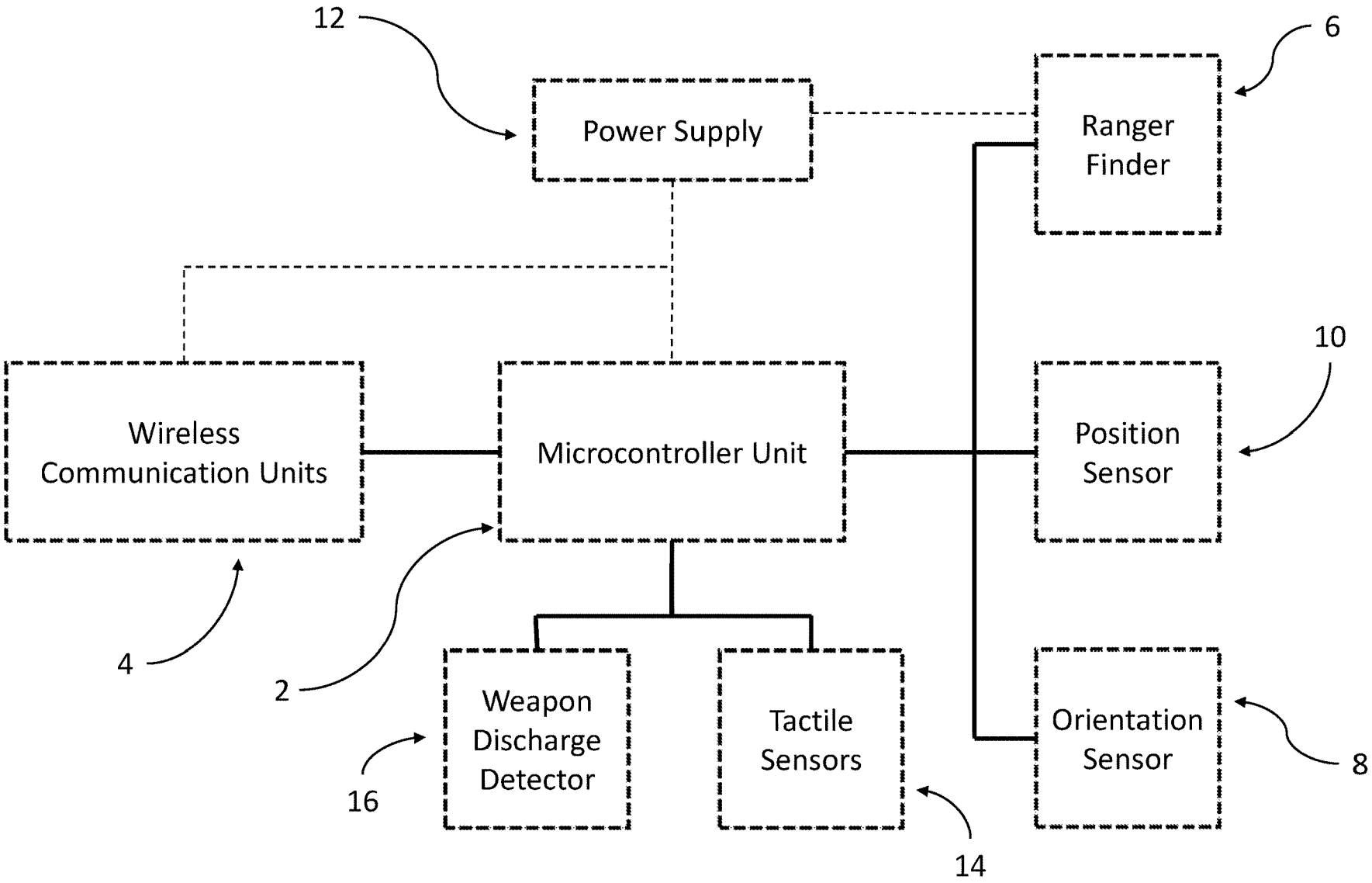
6
Ranger Finder
10
Position Sensor
8
Orientation Sensor
14
Tactile Sensors
Power Supply
Microcontroller Unit
Weapon Discharge Detector
12
2
16
Wireless Communication Units
4

SYSTEMS AND METHODS FOR MEASURING AND COMMUNICATING TACTICAL BATTLEFIELD INFORMATION

This application claims the benefit under 35 U.S.C. 119(e) of the filing date of Provisional U.S. Application Ser. No. 62/861,213, entitled Device for Measuring and Communicating Tactical Battlefield Information, filed on Jun. 13, 2019, which is herein expressly incorporated by reference, in its entirety.

BACKGROUND

Modern military operation requires constant communication between units on the ground and command units. These communications pertain to tactical information such as infantry and vehicle positions, troop movements, positions of enemy combatants, artillery targets, and air support targets. Much of this information such as enemy positions and fire support targets are manually reported by ground troops and are measured using dedicated equipment such as laser designators and manual calculations. Many of these communications are now performed using software for mobile devices such as Kinetic Integrated Low-Cost Software Integrated Tactical Combat Handheld (KILSWITCH) and Android Precision Assault Strike Suite (APASS). While these devices, equipment, and software systems make it much more efficient for ground units to report tactical battlefield information, they still require manual reporting of the information to command units. This manual reporting sacrifices critical time and awareness in combat situations. Requiring the user to dedicate their attention to the system and making the user more vulnerable.

SUMMARY OF THE INVENTION

The present invention is a system and device which automatically measures and reports tactical information, allowing the user to efficiently communicate with command units. The present invention is ideally a rifle-mounted device, which can measure range, orientation, and position. The present invention can automatically report all tactical information, including enemy combatant positions, directions of fire, and friendly positions and headings.

More particularly, there is provided an exemplary system for detecting a firearm discharge and determining information about the geographic target of that firearm, as well as extrapolating tactical engagement data, which system comprises a microcontroller, a weapon discharge detector, a range finder, a position sensor, an orientation sensor, and a wireless communication unit. The system is adapted to use the weapon discharge detector to detect when a firearm is discharged and to communicate this information to the microcontroller unit, the microcontroller unit then utilizes data received from the range finder, the position sensor, and the orientation sensor to calculate instantaneously the angular orientation of the discharged firearm. The system is adapted to instantaneously calculate the global position and altitude of the discharged firearm. The system further comprises a power supply, such as a battery. By combining information from the aforementioned sensors, the system may further be adapted to calculate a geographic location of impact of munitions discharged by the firearm, communicate with a display for showing a user a current position and heading of friendly units, friendly fields of fire, and potential enemy unit locations, and/or to autonomously transmit tactical information data to a command center or nearby vehicles, among other functions. The system may further comprise tactile sensors.

The system may further comprise a housing adapted to enclose elements of the system in a compact manner, the system being adapted for mounting on a weapon, optics, helmet, arm, wrist, person, unmanned system, aircraft, or vehicle. The weapon may comprise a rifle, support equipment, weapons system, vehicle-mounted weapon, or the like.

The invention, together with additional features and advantages thereof, may best be understood by reference to the following description taken in conjunction with the accompanying illustrative drawing.

BRIEF DESCRIPTION OF THE DRAWINGS

FIG. 1 is a schematic diagram of the inventive system.

DETAILED DESCRIPTION OF THE INVENTION

In one exemplary embodiment of the inventive system, with reference to the sole drawing figure, FIG. 1, the system can measure enemy combat positions using typical vector azimuth sensors, namely an orientation sensor 8, a range finder 6, and a positioning sensor 10. This exemplary embodiment automatically reports potential enemy combatant positions and directions of fire by combining this sensor with a weapon discharge detector 16. When the user's weapon is discharged, the microcontroller unit 2 automatically calculates the distance, position, and orientation of the rifle in order to calculate the position of the enemy combatant and the direction of fire. Since the preferred embodiment is mounted to the user's firearm, this information is detected passively and is automatically transmitted to command units. The range finder 6 may comprise any suitable detector including, but not limited to, optical laser range finders, acoustic sensors, radio frequency radar sensors, or any other similar sensor known to those skilled in the art. The positioning sensor 10 may comprise any satellite or land-based global positioning system, ideally implementing real-time kinematics for higher precision. In situations where higher altitude resolution, beyond what global positioning systems can provide, is needed, any suitable barometer may be used, such as one that employs MEMS technology, or other sensor known to those skill in the art. The present invention may also make use of other nearby global positioning devices such as those contained in a mobile phone or tablet, and receive position data using Wi-Fi, Bluetooth, or any other appropriate means. The microcontroller unit 2 may be any capable processing unit that has input and outputs such as a field-programmable gate array or reduced instruction set computing processor. The orientation sensor 8 may be any suitable inertial measurement unit capable of using or combining sensor data to calculate orientation. Preferably, the inertial measurement unit employs a sensor based on micromachined electromechanical structures, ring lasers, or fiber optic gyroscopes. The weapon discharge detector 16 may comprise acoustic sensors, inertial sensors, ammunition sensors, force sensors, any combination thereof, or any similar system known to the art. The combination of all of these sensors can be combined with geographic and topographic information to detect the location of friendly forces, the location of enemy forces, whether friendly forces are discharging their weapons, the direction of friendly fire, whether friendly forces are firing from high ground or low ground, and whether or not a weapon is raised. Wireless communication units 4 transmit this information using radio frequencies, microwave frequencies, satellite networks, cellular networks, or any other communication system known to those skilled in the art. In exemplary embodiments, the system communicates over Bluetooth or Wi-Fi to a user's tablet or mobile phone, and interacts with mobile programs such as Kinetic Integrated Low-Cost Software Integrated Tactical Combat Handheld (KILSWITCH) and Android Precision Assault Strike Suite (APASS). However, the present invention may maintain short-range communication to any other communication, optics, visors, mobile devices, or display equipment. Since the programs identified above are already widely deployed, integration of the present invention is ideal and relieves the need for a user to handle their tablet or additional measurement equipment. The system automatically reports coordinates and tactical information for air and ground support to command units and maps. Custom software may also be written to display this information in real-time giving command units a greater situational awareness of the battlefield.

A tactile sensor 14 interface in the exemplary embodiment may be used to enable various, non-passive, features of the device. These features may include marking potential enemy locations, regions of interest, suggesting waypoints, requesting air support, requesting fire support, and the like. This device may also be used to command semi-autonomous drone support. Communicating directly with the drone, the user can command the drone to follow, survey, reconnaissance an area, suppress an area, or target an area simply by aiming their weapon and using the tactile sensor interface 14. The tactile sensors 14 may consist of buttons, switches, potentiometers, capacitive sensors, resistive sensors, or any other appropriate control interface. A display may also be used to show the user what function or mode the device is currently operating in. The device power supply 12 may be a battery or a source from another piece of equipment. The battery may be of any suitable chemistry, preferably lithium polymer or lithium iron phosphate for their energy density and stability. Information from the device may also be transmitted to another device in order to display real-time battlefield information to the user's helmet, optics, wristband, watch, wearable, phone, tablet, or eyewear. The device itself may be mounted, but is not limited to, the rail of a firearm, the barrel of a firearm, the receiver of a firearm, the optics of a firearm, vehicles, vehicle weapons, helmets, body armor, wrist wears, gloves, or other support equipment.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention, as set forth in the claims.

What is claimed is:

1. A system for detecting a firearm discharge and determining information about the discharged firearm and its targeted location, comprising:

a microcontroller unit;

a weapon discharge detector;

vector azimuth sensors;

a wireless communication unit; and a housing adapted to enclose elements of the system, the elements enclosed by the housing including the microcontroller unit, the weapon discharge detector, the vector azimuth sensors, and the wireless communication unit, the system being adapted for mounting on a firearm;

wherein the system is adapted to use the weapon discharge detector to detect when the firearm on which the system is mounted is discharged and to communicate this information to the microcontroller unit, the microcontroller unit then utilizing data received from the vector azimuth sensors to calculate instantaneously the angular orientation of the discharged firearm.

2. The system as recited in claim 1, wherein the system is adapted to instantaneously calculate the global position and altitude of the discharged firearm.

3. The system as recited in claim 1, and further comprising a power supply.

4. The system as recited in claim 3, wherein the power supply comprises a battery.

5. The system as recited in claim 1, wherein the system is adapted to calculate a geographic location of a target of the discharged firearm.

6. The system as recited in claim 1, wherein the system is adapted to communicate with a display for showing a user a current position and heading of friendly and enemy units.

7. The system as recited in claim 1, wherein the system is adapted to autonomously transmit tactical information data to a command center or nearby vehicles.

8. The system as recited in claim 1, and further comprising tactile sensors.

9. The system as recited in claim 1, wherein the vector azimuth sensors comprise an orientation sensor, a range finder, and a positioning sensor.

10. The system as recited in claim 9, wherein the range finder comprises at least one of an optical laser range finder, an acoustic sensor, and a radio frequency radar sensor.

11. The system as recited in claim 9, wherein the positioning sensor comprises a satellite or land-based global positioning system.

12. The system as recited in claim 9, wherein the orientation sensor comprises an inertial measurement unit adapted to use or combine sensor data to calculate orientation.

13. The system as recited in claim 1, wherein the weapon discharge sensor comprises one or more of an acoustic sensor, an inertial sensor, an ammunition sensor, or a force sensor.

14. The system as recited in claim 8, wherein the tactile sensors comprise any one or more of buttons, switches, potentiometers, capacitive sensors, and resistive sensors.

* * * * *